US006257448B1

(12) United States Patent
D'Andrade et al.

(10) Patent No.: US 6,257,448 B1
(45) Date of Patent: Jul. 10, 2001

(54) BACKPACK EXTERNALLY CHARGEABLE BLADDER GUN ASSEMBLY

(76) Inventors: Bruce M. D'Andrade, deceased, late of Whitehouse Station, NJ (US); by Mary Ann D'Andrade, executrix, 3 Ten Eyck Rd., Whitehouse Station, NJ (US) 08889

( * ) Notice: Subject to any disclaimer, the term of this patent is extended or adjusted under 35 U.S.C. 154(b) by 0 days.

(21) Appl. No.: 09/227,063

(22) Filed: Jan. 5, 1999

Related U.S. Application Data

(60) Provisional application No. 60/088,951, filed on Jun. 11, 1998.

(51) Int. Cl.[7] ..... A63H 3/18; B67D 5/64; B67D 5/42; G01F 11/00

(52) U.S. Cl. ..... 222/79; 222/175; 222/386.5

(58) Field of Search ..... 222/78, 79, 175, 222/325, 95, 386.5, 145.1

(56) References Cited

U.S. PATENT DOCUMENTS

| | | | |
|---|---|---|---|
| 275,997 | 4/1883 | Chapelain . | |
| 600,552 | 3/1898 | Parker . | |
| 605,430 | 6/1898 | Humphrey . | |
| 617,495 | 1/1899 | Reimann . | |
| 688,882 | 12/1901 | Parker . | |
| 1,986,484 | 1/1935 | Schlueter . | |
| 2,237,678 | 4/1941 | Lohr et al. . | |
| 2,513,506 | 7/1950 | Mendelson . | |
| 2,802,298 | 8/1957 | Larin . | |
| 2,844,351 | 7/1958 | Smith . | |
| 3,151,706 | 10/1964 | Dillenburger et al. . | |
| 3,190,229 | 6/1965 | Turowski . | |
| 3,229,417 | 1/1966 | Stanzel . | |
| 3,232,001 | 2/1966 | Stanzel . | |
| 3,406,633 | 10/1968 | Schomburg . | |
| 3,486,539 | 12/1969 | Jacuzzi . | |
| 3,839,945 | 10/1974 | Jacobellis . | |
| 3,848,808 | 11/1974 | Fetty et al. . | |
| 3,876,115 | 4/1975 | Venus, Jr. et al. . | |
| 3,878,639 | 4/1975 | Scheelar et al. . | |
| 4,121,737 | 10/1978 | Kain . | |
| 4,135,559 | 1/1979 | Barnby . | |
| 4,194,461 | 3/1980 | Kubiatowicz . | |
| 4,212,460 | 7/1980 | Kraft . | |
| 4,257,460 | 3/1981 | Paranay et al. . | |
| 4,319,426 | 3/1982 | Lee . | |
| 4,328,843 * | 5/1982 | Fujii | 222/386.5 |
| 4,458,830 | 7/1984 | Werding . | |
| 4,673,010 | 6/1987 | Prufer et al. . | |
| 4,735,239 | 4/1988 | Salmon et al. . | |
| 4,807,586 | 2/1989 | Kao . | |
| 4,854,480 | 8/1989 | Shindo . | |
| 4,867,208 | 9/1989 | Fitzgerald et al. . | |
| 4,890,838 | 1/1990 | Rudell et al. . | |
| 4,892,081 | 1/1990 | Moormann . | |

(List continued on next page.)

OTHER PUBLICATIONS

Yes! Entertainment Speed Loader 1500 instructions. ©1997. Not admitted as prior art.

*Primary Examiner*—Joseph A. Kaufman
*Assistant Examiner*—Stephanie L. Willatt
(74) *Attorney, Agent, or Firm*—Akin, Gump, Strauss, Hawer & Feld, L.L.P.

(57) ABSTRACT

The present invention relates to a gun assembly for dispensing a fluid with a quick charge adapter. The gun assembly includes a plurality of expandable bladders located in housings which are connected to a supply manifold. The supply manifold is connected to a remotely located gun which is adapted to dispense fluid stored in the bladders upon activation of a trigger. The fluid may be dispensed through a selected one of multiple ejection nozzles located on the gun that can be selected by the user. A recharge nozzle located on the gun is adapted to be inserted into the quick charge adapter to quickly expand and fill the bladders from a pressurized supply.

20 Claims, 2 Drawing Sheets

U.S. PATENT DOCUMENTS

| | | | | |
|---|---|---|---|---|
| 4,944,521 | | 7/1990 | Greeno . | |
| 4,991,847 | | 2/1991 | Rudell et al. . | |
| 5,018,449 | | 5/1991 | Eidson, II . | |
| 5,032,100 | | 7/1991 | Goldfarb . | |
| 5,064,095 | | 11/1991 | Camerino . | |
| 5,088,522 | | 2/1992 | Rath et al. . | |
| 5,127,118 | | 7/1992 | Johenning . | |
| 5,174,477 | | 12/1992 | Schafer . | |
| 5,188,610 | * | 2/1993 | Rains | 222/175 |
| 5,234,129 | | 8/1993 | Lau . | |
| 5,240,450 | | 8/1993 | Graham . | |
| 5,248,089 | * | 9/1993 | Bekius | 222/175 |
| 5,288,256 | | 2/1994 | Lee et al. . | |
| 5,328,055 | * | 7/1994 | Battle | 222/325 |
| 5,336,051 | | 8/1994 | Tamari . | |
| 5,354,225 | | 10/1994 | Hix . | |
| 5,366,108 | | 11/1994 | Darling . | |
| 5,373,833 | | 12/1994 | D'Andrade . | |
| 5,373,975 | | 12/1994 | Husted . | |
| 5,529,525 | | 6/1996 | Deal . | |
| 5,531,626 | | 7/1996 | Deal . | |
| 5,531,627 | | 7/1996 | Deal . | |
| 5,603,361 | * | 2/1997 | Cuisinier | 222/79 |
| 5,799,827 | | 9/1998 | D'Andrade . | |
| 5,875,927 | | 3/1999 | D'Andrade . | |
| 5,915,771 | | 6/1999 | Amron . | |
| 5,984,199 | * | 11/1999 | Restive | 239/1 |

* cited by examiner

BACKPACK EXTERNALLY CHARGEABLE BLADDER GUN ASSEMBLY

CROSS REFERENCE TO RELATED APPLICATIONS

This application claims the benefit of U.S. provisional application Ser. No. 60/088,951, filed Jun. 11, 1998.

BACKGROUND OF THE INVENTION

The present invention is directed to expandable bladder guns for dispensing fluid, and more specifically, to a toy gun having an expandable bladder which can be charged via an auxiliary connection to a pressurized fluid source.

Guns for ejecting a fluid which include a bladder that is expanded upon having a fluid pumped into it and which use the elastic property of the bladder as the motive force for discharging the fluid are known. One such gun, described in Applicant's prior U.S. patent application Ser. No. 08/672,941, filed on Jun. 28, 1996, now U.S. Pat. No. 5,799,827, which is incorporated by reference as if fully set forth, utilizes a bladder arrangement in the gun housing which is charged using a pump located on the gun to move liquid from a storage tank located on the gun into the bladder. This type of gun has proven to be extremely popular. However, a user is required to manually actuate the pump which takes additional time and may be difficult for younger users. In most instances, an external pressurized fluid source, such as public water, is generally available. It would be desirable to allow rapid charging of a gun without the need for using a manual pump. It would also be desirable to provide a gun having a large capacity to increase the time between refills without the disadvantage of having a reservoir on the gun making the gun heavier and more difficult to wield.

SUMMARY OF THE INVENTION

Briefly stated, the present invention provides a gun assembly comprising a backpack assembly having a first restricter tube. The first restricter tube has first and second ends, with the first end having an opening. An expandable bladder having two ends is located within the first restricter tube. The first end of the bladder has an opening located at the opening of the first restricter tube and the second end of the bladder is closed. A supply manifold is located at the first end of the first restricter tube and is connected to the first end of the bladder. The supply manifold has a discharge end and is in fluid communication with the bladder. A remotely located gun is provided which has a gun manifold which is in fluid communication with the discharge end of the supply manifold.

In another aspect, the present invention provides a combination of a gun assembly and a quick charge adapter for charging the gun assembly from an external source of pressurized fluid. The gun assembly includes a backpack assembly and a remotely located gun for discharging a fluid. The backpack assembly includes a first restricter tube. The first restricter tube has first and second ends, with the first end having an opening. An expandable bladder is located within the first restricter tube. The bladder has two ends, with the first end having an opening located at the opening of the first restricter tube. A supply manifold is located at the first end of the first restricter tube and connected to the first end of the bladder such that the supply manifold is in fluid communication with the bladder. The supply manifold has a discharge end. The remotely located gun includes a housing with a gun manifold located in the housing and in fluid communication with the supply manifold via a connection such that fluid can flow between the supply manifold and the gun manifold. An ejection nozzle is provided in fluid communication with the gun manifold. A trigger is located on the housing, and a release valve is connected to the trigger. The release valve is in fluid communication with the gun manifold whereby activation of the trigger activates the release valve to discharge fluid from the ejection nozzle. A recharge nozzle is provided in fluid communication with the gun manifold and is adapted to be inserted into a recharge adapter such that pressurized fluid flows from the recharge adapter into the recharge nozzle, through the gun manifold to the supply manifold and to the expandable bladder such that the bladder is expanded by the pressurized fluid. A recharge adapter is provided and is adapted to be connected to a pressurized fluid supply. The recharge adapter includes a receptacle which is adapted to receive the gun recharge nozzle.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings, an embodiment which is presently preferred. It should be understood, however, that the invention is not limited to the precise arrangements and instrumentalities shown. In the drawings.

DETAILED DESCRIPTION OF THE INVENTION

Figures 1, 2:
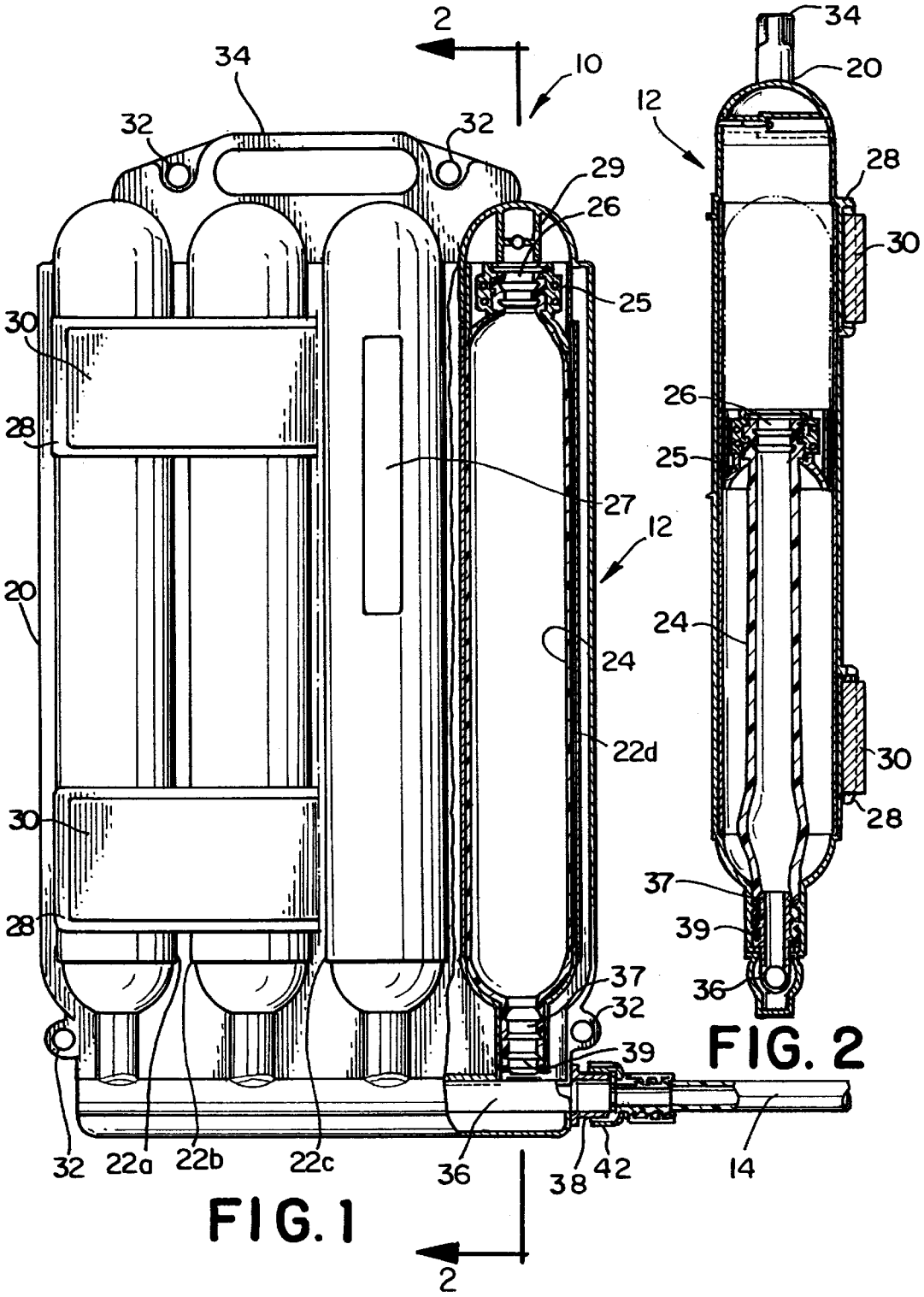
FIG. 1 is a split front view/rear elevational view of a backpack assembly of the backpack externally chargeable bladder gun assembly of the present invention.
FIG. 2 is a cross-sectional view taken along lines 2—2 in FIG. 1.

Certain terminology is used in the following description for convenience only and is not limited. The word "right," "left," "lower" and "upper" designate directions in the drawings to which reference is made. The words "inwardly" and "outwardly" refer to directions towards and away from, respectively, the geometric center of the backpack assembly and gun portions of the backpack hose-charged bladder gun in accordance with the present invention, and designated parts thereof. The terminology includes the words noted above as well as derivatives thereof and words of similar import.

Figure 3:
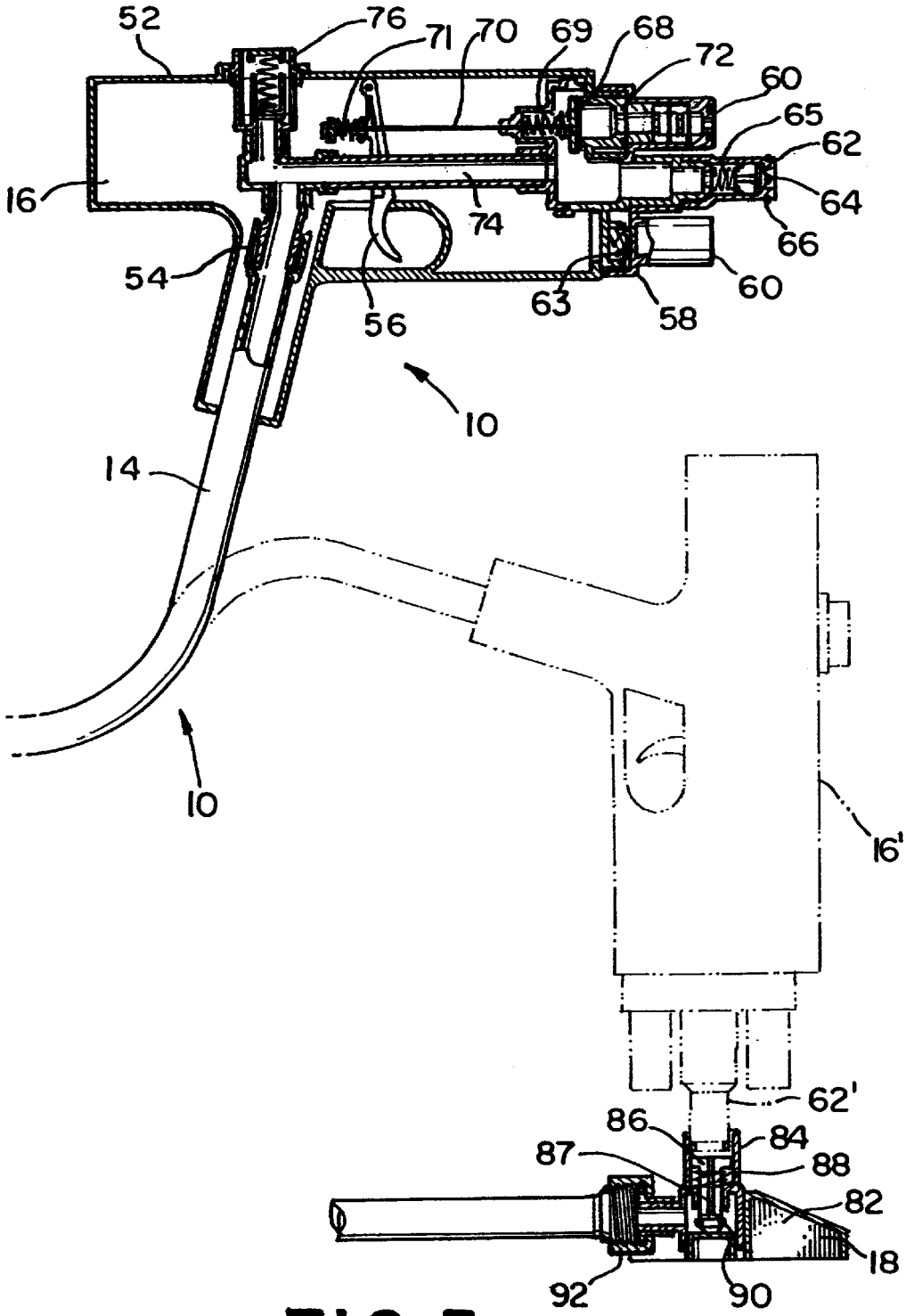
FIG. 3 is a cross-sectional view of the gun connected to the backpack shown in FIG. 1 and a quick charge hose adapter.

Referring to the drawings, wherein like numerals indicate like elements throughout, there is shown in FIGS. 1–3 a backpack externally chargeable bladder gun 10 in accordance with the present invention. The backpack externally chargeable bladder gun 10 includes a backpack assembly 12, shown in detail in FIGS. 1 and 2, a connecting hose 14 and a gun assembly 16, shown in FIG. 3. A quick charge adapter 18, also shown in FIG. 3, is provided for charging the gun assembly 16 as will be described in detail below. While the preferred embodiment of the bladder gun 10 is intended to be used with water as a recreational toy, it will be recognized by those skilled in the art from the present disclosure that the bladder gun 10 can be used with other fluids, if desired. For the purposes of the present description, the bladder gun 10 will be referred to in connection with its use as a water gun, although this is not intended to be limiting.

Referring again to FIGS. 1 and 2, the backpack assembly 12 includes a housing 20 having four restricter tubes 22*a*, 22*b*, 22*c* and 22*d* (generally referred to as 22) attached to the housing 20. Each restricter tube 22 has a first open end and a second closed end. A tubular expandable bladder 24 having a closed end and an open end is located in each restricter tube 22, with the open end of each bladder 24 being located at the open end of each restricter tube 22. The open end of each bladder 24 is connected in a parallel arrangement to a supply manifold 36 located at the first end of each restricter tube 22. The first end of each bladder 24 is inserted over one of four branches 37 located on the supply manifold 36 in a parallel arrangement such that each bladder 24 is in fluid communication with the supply manifold 36. Each branch 37 has a plurality of circumferential lips 39 to securely retain the first end of each bladder 24 on its respective branch 37. However, it will be recognized by those skilled in the art from the present disclosure that other methods of securing bladders to branches can be used.

The second end of each bladder 24 is closed using a plug 26 which is attached to a carriage 25. Each carriage 25 is slidably located inside of each restricter tube 22, such that as each bladder 24 is filled, each carriage 25 slides upwardly along the inside wall of each respective restricter tube 22 from the position shown in FIG. 2 until each bladder 24 reaches the filled position, as illustrated in FIG. 1. Each carriage 25 contacts a stop rib 29 located in the closed end of each restricter tube 22, preventing further expansion of each bladder 24. A window 27 is preferably located along each restricter tube 22*a*–22*d*, which allows the user to view a colored line or marker located on or formed as part of each carriage 25, providing a visual indication as to the charge state and the amount of fluid stored in the backpack assembly 12.

Preferably, the bladder 24 is of the type described in Applicant's prior U.S. Pat. No. 5,758,800, which is incorporated herein by reference as if fully set forth. However, it will be recognized by those skilled in the art from the present disclosure that other types of bladders can be used, such as an elongate generally tapered bladder in which only the first end is open and the second end is closed. The arrangement of carriage 25 within restricter tube 22 is also preferably similar to that disclosed in Applicant's prior U.S. patent application Ser. No. 08/672,941, filed Jun. 28, 1996, now U.S. Pat. No. 5,799,827, which is incorporated herein by reference as if fully set forth.

As shown in detail in FIG. 1, the first end of each bladder 24 is connected to the supply manifold 36 via branch 37 such that each bladder 24 is in fluid communication with the supply manifold 36. A fitting 38 is connected to a discharge end of the supply manifold 36 for connection of the hose 14. Preferably, the connection on the hose 14 is a hose connector 42, complementary to the fitting 38, which can be connected or disconnected from the fitting 38 on the backpack assembly 12.

Still with reference to FIGS. 1 and 2, the housing 20 is adapted to be worn by the user. A plurality of flattened areas 28 are provided on the housing 20 of the backpack assembly 12. Preferably, a soft foam pad 30 is located on each flattened area 28 to rest the housing 20 against the user's body. Preferably, the housing 20 also includes loops 32 for the connection of shoulder straps (not shown) or other types of attachments, such as VELCRO® straps, for attaching the backpack to a bicycle or other objects. A handle 34 is also provided on the housing 20 to allow a user to easily grasp the backpack assembly 12.

Referring now to FIG. 3, the hose 14 is connected to the gun assembly 16. The gun assembly 16 includes a gun housing 52. A gun manifold 74 is located in the gun housing 52, and a connection 54 is located on the gun manifold 74 for attaching the hose 14 to the gun manifold 74 whereby fluid can flow between the supply manifold 36 and the gun manifold 74. A turret disk 58 is attached to the gun housing 52 and includes a plurality of ejection nozzles 60 which are arranged in a generally circular pattern and are positionable to be in fluid communication with the gun manifold 74. The ejection nozzle 60 which is aligned with and in fluid communication with the gun manifold 74 is adapted to discharge pressurized fluid from the backpack assembly 20. The turret disk 58 is rotatably mounted about a central recharge nozzle 62. The recharge nozzle 62 is mounted on the gun housing 52 and is in fluid communication with the gun manifold 74. The turret disk 58 is releasably held in position via a detent device 63, such as a spring loaded ball which contacts a complementary depression in the turret disk 58. Preferably, each ejection nozzle 60 is different from each other ejection nozzle 60 to provide a selection of spray patterns as the turret disk 58 is turned to rotate a selected nozzle 60 into fluid communication with the gun manifold 74.

As shown in FIG. 3, the gun manifold 74 is in fluid communication with a release valve 68 having an activating stem 70 which extends outside of the gun manifold 74. An O-ring seal 72 is provided to seal the selected ejection nozzle 60 on the turret disk 58 against the opening of the release valve 68 such that fluid released by the release valve 68 is discharged through the selected ejection nozzle 60.

A trigger 56 is pivotably connected to the gun housing 52 and operatively connected to the stem 70. The trigger 56 is used to actuate the release valve 68 via the stem 70. Release valve 68 is biased to a closed position by release valve spring 69. When the trigger 56 is pulled, the pivoting action of the trigger 56 compresses trigger spring 71 which is located on the stem 70. When sufficient energy is stored in the trigger spring 71, the spring force of the valve spring 69 and the force of the fluid pressure acting on the valve 68 is overcome, and the stem 70 rapidly pulls the release valve 68 from its normally closed position to allow fluid to be discharged from the ejection nozzle 60. When the trigger 56 is released, the release valve 68 returns to a closed position. The release valve 68 may be any suitable type of release valve. Preferably, the release valve is of the type described in Applicant's U.S. Pat. No. 5,339,987, which is incorporated herein by reference as if fully set forth.

A pressure relief valve 76 is also provided in fluid communication with the gun manifold 74 to prevent over pressurization of the gun assembly 10. Preferably, the pressure relief valve 76 is located on the gun assembly 16. However, those skilled in the art will understand from the present disclosure that the pressure relief valve could be provided at other locations in fluid communication with the gun manifold 74, such as the backpack assembly 12.

A spring loaded check valve 64 is located in the recharge nozzle 62 and an O-ring seal 66 is located in a groove on the outside of the recharge nozzle 62 in order to provide a generally fluid tight connection to the quick charge adapter 18 when the recharge nozzle 62 is inserted into the quick charge adapter 18. A recharge nozzle spring 65 biases the check valve 64 to a closed position against the inside of the recharge nozzle 62 to prevent pressurized fluid from escaping from the recharge nozzle 62. The recharge nozzle 62 is in fluid communication with the gun manifold 74, and the recharge nozzle 62 is adapted to receive pressurized fluid from an external source of pressurized fluid to charge the expandable bladders 24 with fluid under pressure.

As shown in FIG. 3, the release valve 68 and the check valve 64 are located within the same chamber and are in fluid communication with the manifold 74 such that the same fluid path is used for both charging the backpack assembly 12 and also discharging fluid from the gun assembly 16.

Still with reference to FIG. 3, the quick charge adapter 18 is shown in cross section. The quick charge adapter 18 includes a housing 82 having a receptacle 84 for receiving the recharge nozzle 62 of the gun assembly 16, shown in phantom lines as 62' and 16' in FIG. 3 in the charging position. A valve body 86 is located within the quick charge adapter housing 82. The valve body 86 has a channel 87 defined therethrough. The valve body 86 is biased to a closed position against the quick charge adapter housing 82 via a spring 88 which causes an O-ring seal 90 located on the valve body 86 to seal against an inside portion of the housing 82, preventing pressurized fluid from leaking from the quick charge adapter 18 when not in use. A hose connection 92 is provided for connecting a garden hose or other source of pressurized fluid to the quick charge adapter 18.

In operation, the recharge nozzle 62 is pushed into the receptacle 84 of the quick charge adapter 18, pushing down the valve body 86 which allows pressurized fluid from the garden hose to enter the channel 87 in the valve body 86. The flow of pressurized fluid overcomes the force of recharge nozzle spring 65 and opens the check valve 64 located in the recharge nozzle 62, allowing pressurized fluid to flow through the gun manifold 74 and the hose 14 into the supply manifold 36 and the tubular expandable bladders 24. The tubular bladders 24 are charged with fluid and expand in size, guided by movement of the carriages 25 to fill the restricter tubes 22*a–d*. The bladders 24 grow until the carriages 25 contact stop ribs 29 located in the backpack housing 20, preventing further expansion. At that time, the bladders 24 are completely restricted by the restricter tubes 22*a–d*. The pressure relief valve 76 is then actuated to prevent over-pressurization of the bladders and the entire system. The pressure relief valve 76 discharges fluid outside the gun housing 52. When the user notes fluid flowing from the pressure relief valve 76, the recharge nozzle 62 is removed from the receptacle 84 on the quick charge adapter 18. The user can rotate the turret disk 58 to select a desired ejection nozzle 60 with a particular spray or shooting pattern.

It will be recognized by those skilled in the art from the present disclosure that the gun 16 may be provided with a single nozzle and that the turret disk 58 with multiple ejection nozzles 60 is not required.

While the backpack assembly 12 in accordance with the preferred embodiment of the invention includes four tubular bladders 24, it will be recognized by those skilled in the art from the present disclosure that the number of bladders 24 may be varied and that bladders of other usable shapes may also be used, with or without a carriage 25 and/or a window 27, if desired.

In the preferred embodiment, the gun assembly 16 and backpack assembly 12 are molded from a polymeric material. However, it will be recognized by those skilled in the art that the gun assembly 16 and the backpack assembly 12 can be made from any desired type of material, and may be molded or machined. Preferably, the bladders 24 are made of natural rubber. However a synthetic bladder material may also be used, if desired.

It will appreciated by those skilled in the art that changes can be made to the embodiment described above without departing from the broad inventive concept thereof. It is understood, therefore, that the invention is not limited to the particular embodiment disclosed, and is intended to cover modifications within the scope and spirit of the present invention as defined by the appended claims.

What is claimed is:

1. A gun assembly comprising:

a backpack assembly having a first restricter tube, the first restricter tube having an open first end and a second end;

an expandable bladder located within the first restricter tube, the bladder having a first end and a second end, the first end having an opening located at the opening of the first restricter tube and the second end being closed;

a supply manifold located at the first end of the first restricter tube and connected to the first end of the bladder whereby the supply manifold is in fluid communication with the bladder, the supply manifold having a discharge end; and a remotely located gun having an ejection nozzle adapted to discharge pressurized fluid from the backpack assembly; and a gun manifold, the gun manifold being in fluid communication with the discharge end of the supply manifold;

the gun assembly further comprising a pressure relief valve separate from the ejection nozzle in fluid communication with one of the supply manifold and the gun manifold.

2. The gun assembly according to claim 1, wherein the pressure relief valve is located on the gun in fluid communication with the gun manifold.

3. A gun assembly comprising:

a backpack assembly having a first restricter tube, the first restricter tube having an open first end and a second end;

an expandable bladder located within the first restricter tube, the bladder having a first end and a second end, the first end having an opening located at the opening of the first restricter tube and the second end being closed;

a supply manifold located at the first end of the first restricter tube and connected to the first end of the bladder whereby the supply manifold is in fluid communication with the bladder, the supply manifold having a discharge end; and a remotely located gun having a gun manifold, the gun manifold being in fluid communication with the discharge end of the supply manifold, wherein the backpack assembly includes a plurality of restricter tubes and an expandable bladder is located in each restricter tube whereby the first end of each of the expandable bladders is connected to the supply manifold in a parallel arrangement.

4. The gun assembly according to claim 3, wherein the plurality of restricter tubes are provided in a housing.

5. The gun assembly according to claim 4, wherein the housing includes mounting provisions and is adapted to be worn by a user.

6. The gun assembly according to claim 5, wherein the housing includes a plurality of pads such that the housing can be rested against the user's body.

7. The gun assembly according to claim 5 wherein the housing includes a plurality of strap connection loops.

8. A gun assembly comprising:

a backpack assembly having a first restricter tube, the first restricter tube having an open first end and a second end;

an expandable bladder located within the first restricter tube, the bladder having a first end and a second end, the first end having an opening located at the opening of the first restricter tube and the second end being closed;

a supply manifold located at the first end of the first restricter tube and connected to the first end of the bladder whereby the supply manifold is in fluid communication with the bladder, the supply manifold having a discharge end; and a remotely located gun having a gun manifold, the gun manifold being in fluid communication with the discharge end of the supply manifold, wherein the gun further comprises a recharge nozzle in fluid communication with the gun manifold, the recharge nozzle being adapted to receive pressurized fluid from an external source of pressurized fluid to charge the expandable bladder with fluid under pressure.

9. A gun assembly comprising:

a backpack assembly having a first restricter tube, the first restricter tube having an open first end and a second end;

an expandable bladder located within the first restricter tube, the bladder having a first end and a second end, the first end having an opening located at the opening of the first restricter tube and the second end being closed;

a supply manifold located at the first end of the first restricter tube and connected to the first end of the bladder whereby the supply manifold is in fluid communication with the bladder, the supply manifold having a discharge end; and a remotely located gun having a gun manifold, the gun manifold being in fluid communication with the discharge end of the supply manifold, wherein the backpack assembly includes four restricter tubes mounted to a housing and an expandable bladder located in each restricter tube whereby the first end of each of the expandable bladders is connected to the supply manifold in a parallel arrangement.

10. The gun assembly according to claim 9, wherein a bladder carriage is attached to the plug, whereby the bladder carriage is slidably located within the first restricter tube, and a window is located along the first restricter tube which allows a user to view a marker on the bladder carriage to indicate a charge level of the backpack assembly.

11. A gun assembly comprising:

a backpack assembly having a first restricter tube, the first restricter tube having an open first end and a second end;

an expandable bladder located within the first restricter tube, the bladder having a first end and a second end, the first end having an opening located at the opening of the first restricter tube and the second end being closing;

a supply manifold located at the first end of the first restricter tube and connected to the first end of the bladder whereby the supply manifold is in fluid communication with the bladder, the supply manifold having a discharge end; and a remotely located gun having a gun manifold, the gun manifold being in fluid communication with the discharge end of the supply manifold, wherein the gun further comprises a gun housing having a turret disk mounted for rotation on the gun housing, the turret disk including a plurality of ejection nozzles which rotatably positionable in fluid communication with the gun manifold.

12. A gun assembly comprising:

a backpack assembly having a first restricter tube, the first restricter tube having an opening first end and a second end;

an expandable bladder located within the first restricter tube, the bladder having a first end and a second end, the first end having an opening located at the opening of the first restricter tube and the second end being closed;

a supply manifold located at the first end of the restricter tube and connected to the first end of the bladder whereby the supply manifold is in fluid communication with the bladder, the supply manifold having a discharge end; and a remotely located gun having a gun manifold, the gun manifold being in fluid communication with the discharge end of the supply manifold, wherein the backpack assembly includes four restricter tubes mounted to a housing and an expandable bladder located in each restricter tube whereby the first end of each of the expandable bladders is connected to the supply manifold in a parallel arrangement.

13. A combination of a gun assembly and a quick charge adapter for charging the gun assembly from an external source of pressurized fluid comprising:

a gun assembly including a backpack assembly and a remotely located gun for discharging a fluid, the backpack assembly including:

a first restricter tube, the first restricter tube having an open first end and a closed second end, an expandable bladder located within the first restricter tube, the bladder having a first end and a second end, the first end having an opening located at the opening of the first restricter tube, and a supply manifold located at the first end of the first restricter tube and connected to the first end of the bladder whereby the supply manifold is in fluid communication with the bladder, the supply manifold having a discharge end, the remotely located gun including:

a housing, a gun manifold located in the housing and in fluid communication with the supply manifold via a connection whereby fluid can flow between the supply manifold and the gun manifold, an ejection nozzle in fluid communication with the gun manifold, a trigger located on the housing, a release valve connected to the trigger and in fluid communication with the gun manifold whereby activation of the trigger activates the release valve to discharge fluid from the ejection nozzle, a recharge nozzle in fluid communication with the gun manifold which is adapted to be inserted into a quick charge adapter such that pressurized fluid flows from the quick charge adapter into the recharge nozzle, through the gun manifold to the supply manifold and to the expandable bladder such that the bladder is expanded by the pressurized fluid, and a quick charge adapter adapted to be connected to a pressurized fluid supply, the quick charge adapter including a receptacle adapted to receive the gun recharge nozzle.

14. The combination according to claim 13, wherein four restricter tubes are provided in the backpack assembly in a parallel arrangement, an expandable bladder is located in each of the four restricter tubes, and the expandable bladders are in fluid communication with the supply manifold.

15. The combination according to claim 14, wherein the second end of each of the bladders is closed using a plug.

16. The combination according to claim 15, wherein a bladder carriage is attached to each of the plugs whereby each of the bladder carriages is slidably located within each of the restricter tubes, and wherein a window is located along each of the restricter tubes which allows the user to view a marker on each of the bladder carriages to indicate a charge level of the backpack assembly.

17. The combination according to claim 13, wherein a pressure relief valve is provided in fluid communication with the gun manifold.

18. The combination according to claim 17, wherein the pressure relief valve is located on the gun.

19. The combination according to claim 13, wherein a check valve is located in the recharge nozzle.

20. The combination according to claim 13, wherein the backpack assembly includes a housing having a plurality of pads for resting the housing against a user's body.

* * * * *